US012398884B2

(12) United States Patent
Gettelfinger et al.

(10) Patent No.: US 12,398,884 B2
(45) Date of Patent: Aug. 26, 2025

(54) ALTERNATE PILOT LIGHT IGNITION FOR GAS POWERED APPLIANCES WITH ELECTRIC IGNITION ASSEMBLY

(71) Applicant: Haier US Appliance Solutions, Inc., Wilmington, DE (US)

(72) Inventors: Chad Gettelfinger, Lawrenceburg, KY (US); Matthew Hendrix, Louisville, KY (US); Andrew Combs, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 443 days.

(21) Appl. No.: 17/968,298

(22) Filed: Oct. 18, 2022

(65) Prior Publication Data

US 2024/0125474 A1 Apr. 18, 2024

(51) Int. Cl.
*F23N 5/24* (2006.01)
*F23N 1/00* (2006.01)

(52) U.S. Cl.
CPC ..... *F23N 5/242* (2013.01); *F23N 1/002* (2013.01); *F23N 2227/16* (2020.01); *F23N 2227/30* (2020.01); *F23N 2227/36* (2020.01); *F23N 2231/04* (2020.01); *F23N 2241/08* (2020.01)

(58) Field of Classification Search
CPC ..... F23N 5/242; F23N 1/002; F23N 2227/16; F23N 2227/30; F23N 2227/26; F23N 2241/08; F23N 2231/04
USPC ..... 431/6
See application file for complete search history.

(56) References Cited

U.S. PATENT DOCUMENTS

| | | | | |
|---|---|---|---|---|
| 5,429,111 | A * | 7/1995 | Akamatsu | F23N 5/203 126/39 BA |
| 9,920,933 | B2 | 3/2018 | Petersen et al. | |
| 10,478,016 | B2 | 11/2019 | McLemore et al. | |
| 10,670,302 | B2 | 6/2020 | Hazzard et al. | |
| 11,067,285 | B2 | 7/2021 | Andueza et al. | |
| 2013/0104814 | A1* | 5/2013 | Reyman | F24H 15/31 122/14.21 |
| 2018/0372374 | A1* | 12/2018 | Bailey | F24H 1/205 |

FOREIGN PATENT DOCUMENTS

| | | | |
|---|---|---|---|
| CA | 2415629 | A1 | 7/2004 |
| FR | 2509019 | A1 | 1/1983 |

* cited by examiner

*Primary Examiner* — Vivek K Shirsat
(74) *Attorney, Agent, or Firm* — Dority & Manning, P.A.

(57) ABSTRACT

An ignition system for igniting a gas burner of an appliance includes a gas burner, an electric igniter assembly, a pilot light, and a controller. The pilot light is ignitable by the electric igniter assembly. The controller is configured to operate the electric igniter assembly for ignition of the gas burner, detect a power disruption event, ignite the pilot light using the electric igniter assembly in response to detecting the power disruption event, and use the pilot light for ignition of the gas burner during the power disruption event. Methods of operating the ignition system for igniting the gas burner of the appliance are also provided.

14 Claims, 6 Drawing Sheets

ALTERNATE PILOT LIGHT IGNITION FOR GAS POWERED APPLIANCES WITH ELECTRIC IGNITION ASSEMBLY

FIELD OF THE INVENTION

The present subject matter relates generally to appliances, and more particularly to ignition systems for gas appliances.

BACKGROUND OF THE INVENTION

Gas powered appliances, such as gas cooktops, gas ranges, and water heaters generally are powered by gas flames during use. Such appliances may generally have a gas burner that directs a flame to heat a cooktop, water tank, or other component, depending on the appliance. To avoid having to manually ignite the flame each time the appliance is used, gas powered appliances may have an electronic ignition assembly that lights on demand. The electronic ignition assembly lights the gas at the burner at the beginning of each operation of the gas appliance.

An alternative to electronic ignition includes a pilot light ignition system. The pilot light is a small flame that may be left constantly burning within the appliance, the pilot light used to ignite gas flowing to a burner of the appliance. However, pilot light ignition systems are generally deemed inefficient, as they burn fuel even when the appliance is not in use.

Challenges exist when the use of electricity is not desired, such as for religious observance, or when electricity is unavailable, such as during a power outage. When electricity is unavailable, an electronic ignition assembly also is unavailable. This can render an otherwise useful appliance unavailable for use, as the gas burner needs an ignition source to begin to function. In some cases, a manual method such as lighting a match may be used to manually light the burner, which may be challenging or inconvenient.

Accordingly, an improved system of igniting a gas burner would be beneficial. Additionally, a gas burner that does not rely on external electrical power or require a constant source of gas, would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an ignition system is provided. The ignition system may be for igniting a gas burner of an appliance. The ignition system may include a gas burner, an electric igniter assembly, a pilot light ignitable by the electric igniter assembly and a controller in operable communication with the electric igniter assembly. The controller may be configured to operate the electric igniter assembly for ignition of the gas burner, detect a power disruption event, ignite the pilot light using the electric igniter assembly in response to detecting the power disruption event, and use the pilot light for ignition of the gas burner during the power disruption event.

In another exemplary aspect of the present disclosure a method of operating an appliance is provided. The appliance may have a gas burner, an electric igniter assembly and a pilot light. The method may include the steps of operating the electric igniter assembly for ignition of the gas burner, detecting a power disruption event, igniting the pilot light using the electric igniter assembly in response to detecting the power disruption event, and using the pilot light for ignition of the gas during the power disruption event.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Use of the same or similar reference numerals in the figures denotes the same or similar features unless the context indicates otherwise.

DETAILED DESCRIPTION

Figure 1:
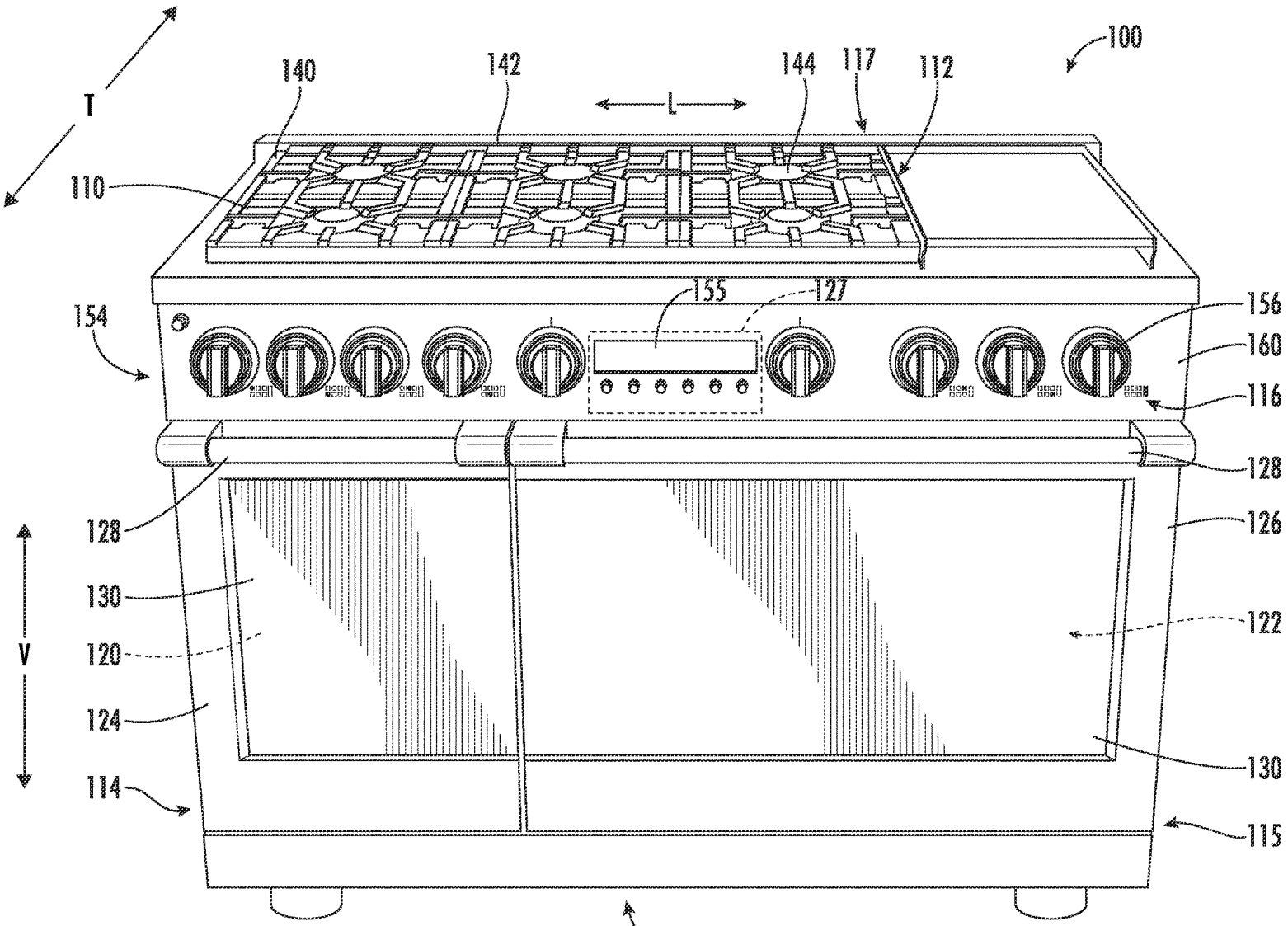
FIG. 1 provides a perspective view of a gas range appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). The terms "coupled," "fixed," "attached to," and the like refer to both direct coupling, fixing, or attaching, as well as indirect coupling, fixing, or attaching through one or more intermediate components or features, unless otherwise specified herein. Terms such as "left," "right," "front," "back," "top," or "bottom" are used with reference to the perspective of a user accessing the oven appliance. For example, a user stands in front of the oven to open the doors and reaches into the cooking chamber(s) to access items therein.

The present invention advantageously provides an appliance with a gas burner that may provide an alternative ignition assembly during a power disruption event. The power disruption event may be an event where an electric igniter assembly would be unavailable or unwanted (e.g., for religious reasons). Advantageously, the gas burner is available with and without external electricity available and is more efficient than a pilot light alone. Appliances with a pilot light alone continuously use gas to power the pilot light, which may be inefficient as compared to embodiments described herein. The embodiments herein may also be advantageous for use in religious settings or observances where the use of electricity is unwanted, but the use of a flame already lit is allowable for preparing or heating food.

Figure 2:
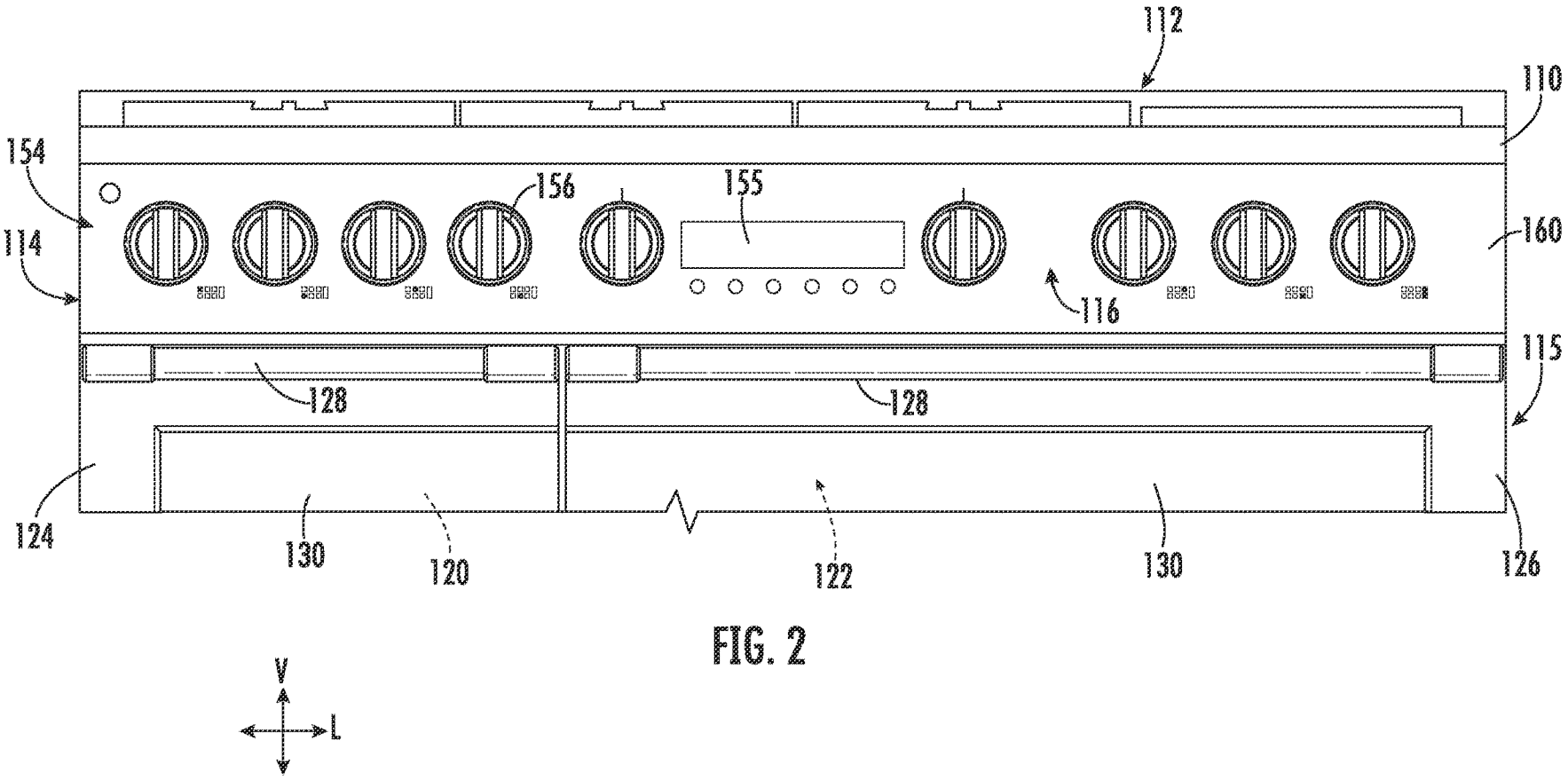
FIG. 2 provides a front view of the gas range appliance of FIG. 1 according to exemplary embodiments of the present disclosure.

Turning now to the figures, FIG. 1 provides a front, perspective view of a household appliance 100 as may be employed with the present disclosure. FIG. 2 provides an elevation view of a top portion or region of appliance 100. Appliance 100 includes an insulated cabinet housing or cabinet 110. As shown, appliance 100 defines a vertical direction V, a lateral direction L, and a transverse direction T (e.g., at cabinet 110). The vertical direction V, lateral direction L, and transverse direction T are mutually perpendicular and form an orthogonal direction system.

Cabinet 110 is generally configured for containing or supporting various components of appliance 100 and may also define one or more internal chambers or compartments of appliance 100. In this regard, as used herein, the terms "cabinet," "housing," and the like are generally intended to refer to an outer frame or support structure for appliance 100 (e.g., including any suitable number, type, and configuration of support structures formed from any suitable materials, such as a system of elongated support members, a plurality of interconnected panels, or some combination thereof). It should be appreciated that cabinet 110 does not necessarily require an enclosure and may simply include open structure supporting various elements of appliance 100. By contrast, cabinet 110 may enclose some or all portions of an interior of cabinet 110. It should be appreciated that cabinet 110 may have any suitable size, shape, and configuration while remaining within the scope of the present subject matter.

As shown, cabinet 110 extends along the vertical direction V between a top portion 112 and a bottom portion 113; along the lateral direction L between a left side portion 114 and a right side portion 115; and along the traverse direction T between a front portion 116 and a rear portion 117. In some embodiments, cabinet 110 defines multiple discrete cooking chambers, such as a first or left cooking chamber 120 and a second or right cooking chamber 122. Thus, appliance 100 may generally referred to as a double oven range appliance. As will be understood by those skilled in the art, appliance 100 is provided by way of example only, and the present subject matter may be used in any suitable appliance (e.g., a single-chamber oven appliance). Thus, the example embodiments illustrated in the present figures are not intended to limit the present disclosure matter to any particular cooking chamber configuration or arrangement, except as otherwise indicated.

Left and right cooking chambers 120 and 122 are configured for the receipt of one or more food items to be cooked. Heating elements (not shown), such as electric resistance heating elements, gas burners, microwave heating elements, halogen heating elements, or suitable combinations thereof, are positioned within left cooking chamber 120 and right cooking chamber 122 for heating left cooking chamber 120 and right cooking chamber 122.

In the illustrated embodiments, appliance 100 includes a left door 124 and a right door 126 movably (e.g., rotatably) attached to cabinet 110 in order to restrict or permit selective access to left cooking chamber 120 and right cooking chamber 122, respectively. Each door 124, 126 extends (e.g., laterally) between a first side 162 and a second side 164. Since doors 124, 126 are positioned beside each other, an inner (e.g., laterally inward) side of each door 124 and 126 will thus be disposed proximal or adjacent to each other. In particular, the second side 164 of the first door 124 may be disposed or mounted next to first side 162 of second door 126. The outer sides (i.e., the first side 162 of the first door 124 and the second side 164 of the second door 126) are positioned distal to each other and the inner sides, such as at the first side portion 114 and the second side portion 115 of the cabinet 110. Handles 128 are mounted to left and right doors 124 and 126 to assist a user with opening and closing doors 124 and 126 in order to access cooking chambers 120 and 122. As an example, a user can pull on the handle 128 mounted to left door 124 to open or close left door 124 and access left cooking chamber 120. As will be described in greater detail below, glass window panes 130 are provided for viewing the contents of left and right cooking chambers 120 and 122 when doors 124 and 126 are closed and also assist with insulating the cooking chambers 120 and 122.

In optional embodiments, appliance 100 includes a cooktop 140. Cooktop 140 may be positioned at or adjacent to the top portion 112 of cabinet 110. Thus, cooktop 140 is positioned above left and right cooking chambers 120 and 122. Cooktop 140 includes a top panel 142. By way of example, top panel 142 may be constructed of glass, ceramics, enameled steel, and combinations thereof.

For appliance 100, a utensil (not pictured) holding food or cooking liquids (e.g., oil, water, etc.) may be placed onto one or more of gas burners 144 (e.g., on a cooking grate). Gas burners 144 provide thermal energy to cooking utensils thereon. As shown in FIG. 1, gas burners 144 can be configured in various sizes so as to provide for the receipt of cooking utensils (e.g., pots, pans, etc.) of various sizes and configurations and to provide different heat inputs for such cooking utensils.

In some embodiments, user interface or control panel 154 is located within convenient reach of a user of the appliance 100. For some example embodiments, user interface panel 154 includes a front panel 160 disposed on the front portion 116 of cabinet 110. As shown, front panel 160 may be mounted to cabinet 110. Moreover, user interface panel 154 may include one or more knobs 156 that are each associated with one of gas burners 144. Knobs 156 allow the user to activate each burner assembly and determine the amount of heat input provided by each gas burner 144 to a cooking utensil located thereon. User interface panel 154 may also be provided with one or more graphical displays 155 that deliver certain information to the user such as, for example, whether a particular burner assembly is activated or the rate at which the burner assembly is set.

Although shown with knobs 156, it should be understood that knobs 156 and the configuration of appliance 100, shown in FIGS. 1 and 2, is provided by way of example only. More specifically, user interface panel 154 may include various input components, such as one or more of a variety of touch-type controls, electrical, mechanical, or electromechanical input devices including rotary dials, push buttons, and touch pads. Optionally, the graphical display 155 may be provided as a touch screen interface configured to receive input commands from a user (e.g., via a capacitive touch panel). Moreover, the user interface panel 154 may include other display components, such as a digital or analog display device designed to provide operational feedback to a user.

Appliance 100 may be further equipped with a controller 127 to regulate operation of the appliance 100. For example, controller 127 may regulate the operation of one or more portions of appliance 100, such as the gas burners 144, user interface 154, etc. Controller 127 may be in communication (via, for example, a suitable wired or wireless connection) with user interface 154 (e.g., at graphical display 155 or knobs 156). In general, controller 127 may be operable to configure the appliance 100 (and various components thereof) for cooking. Such configuration may be based on a plurality of cooking factors of a selected operating cycles, sensor feedback, etc. By way of example, controller 127 may include one or more memory devices 148 and one or more processors 150, such as general or special purpose microprocessors operable to execute programming instructions or micro-control code associated with an operating cycle. The memory 148 may represent random access memory such as DRAM, or read only memory such as ROM or FLASH. In one embodiment, the processor 150 executes programming instructions stored in memory 148. The memory 148 may be a separate component from the processor 150 or may be included onboard within the processor 150. The memory 148 can store information accessible to processor 150, including instructions that can be executed by processor 150. Optionally, the instructions can be software or any set of instructions that when executed by the processor 150, cause the processor 150 to perform operations. For certain embodiments, the instructions include a software package configured to operate appliance 100 and execute certain tasks.

Controller 127 may be positioned in a variety of locations throughout appliance 100. As an example, one or more portions of controller 127 may be located within a user interface panel 154 of appliance 100. In such an embodiment, input/output ("I/O") signals may be routed between the control system and various operational components of appliance 100 along wiring harnesses that may be routed through cabinet 110. Typically, controller 127 is in communication with user interface panel 154 through which a user may select various operational features and modes and monitor progress of appliance 100. In example embodiments, user interface panel 154 may represent a general purpose I/O ("GPIO") device or functional block.

As will be understood by those skilled in the art, appliance 100 is provided by way of example only, and the present subject matter may be used in any suitable household appliance (e.g., a household appliance using gas as a power source). Thus, the present subject matter may be used with other household appliances having different configurations, such as gas ranges, wall ovens, gas ovens, gas cooktops, etc. The present subject matter may further be used with other household appliances such as water heater appliances, gas grill appliances, furnaces, clothes dryers, other gas powered household appliances, etc. Appliance 100 will be described below, with the understanding that other embodiments may include or be provided as another suitable household appliance (e.g., having a gas burner assembly).

Figure 3:
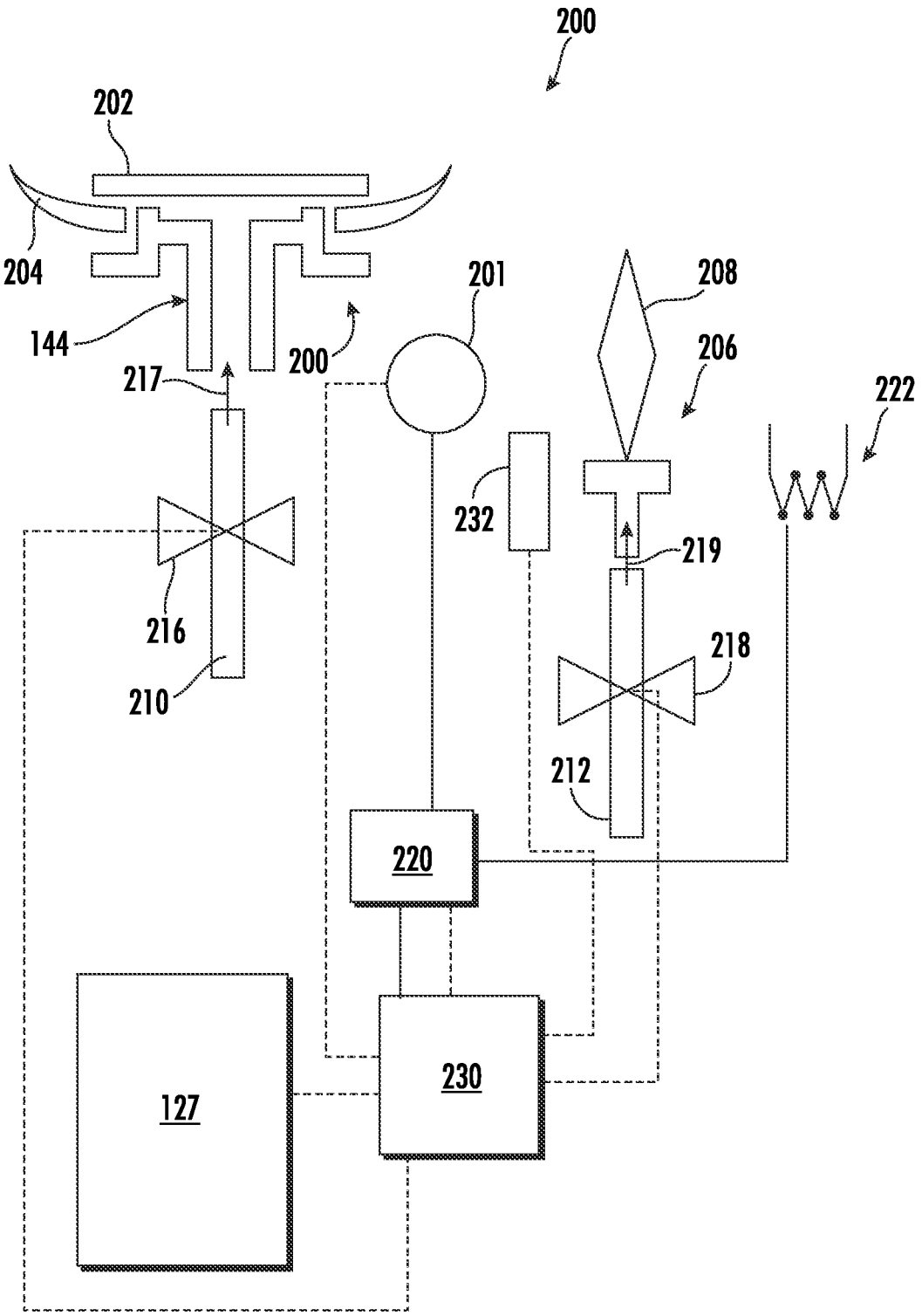
FIG. 3 provides a schematic view of a gas ignition system connected to a burner of a household appliance according to exemplary embodiments of the present disclosure.

As shown in FIG. 3, which depicts a schematic view of an ignition system 200. Appliance 100 may include ignition system 200 or components of ignition system 200 as described herein. For example, ignition system 200 includes gas burner 144. Ignition system 200 may have several components including gas burner 144, controller 127, electric igniter assembly 201, and pilot light 206. Ignition system 200 may be designed to ignite the gas burner 144 of appliance 100. Although gas burner 144 is illustrated herein as being used with oven appliance 100, it should be appreciated that aspects of the present subject matter are applicable to any suitable gas burner in any suitable appliance, e.g., including a gas water heater, a gas range, or a gas cooktop appliance 100.

Gas burner 144 may include a gas burner cap 202. Gas burner cap 202 may be located along cooktop 140 of appliance 100. Gas burner cap 202 may form a gas chamber and may define ports through which the gas is ejected and ignited to form gas burner flame 204. An article, such as a pot, pan, etc., may be placed proximate to gas burner cap 202 to heat the article using the ignited gas burner flame 204.

Gas burner 144 may include a primary gas line 210. Primary gas line 210 may provide gas to gas burner 144, which, when ignited, may produce gas burner flame 204. The amount of gas that flows from primary gas line 210 to gas burner 144 may be controlled by use of primary gas valve 216. Controller 127, an auxiliary controller 230 (which will be discussed in more detail below), or a manual controller 127 such as knob 156, may control primary gas valve 216 to provide gas to gas burner 144. Gas may flow in primary gas flow direction 217 toward gas burner 144.

Electric igniter assembly 201 may be used to ignite gas to create gas burner flame 204, when available. For example, electric igniter assembly 201 may ignite gas from primary gas line 210 flowing to gas burner 144. Electric igniter assembly 201 is configured to use electric power to generate a spark to ignite flowing gas. Electric igniter assembly 201 may be any suitable electric spark generator, as would be understood. Controller 127, auxiliary controller 230, or a manual controller 127 such as knob 156 may initiate spark generation of electric igniter assembly 201 upon opening primary gas valve 216 to allow gas to flow along flow direction 217. Using electric igniter assembly 201 to ignite gas for gas burner 144 may be considered normal operating conditions or normal operation of appliance 100 or ignition system 200, as used herein.

Pilot light 206 may be proximate to gas burner 144 and to electric igniter assembly 201. During a power disruption event, pilot light 206 may be used to ignite primary gas line 210 to ignite gas burner 144. Pilot light 206 may be unlit during appliance 100 operation in a normal mode or operations using external power, such as when appliance 100 is plugged into a wall socket or other external electrical power source. Pilot light 206 may be lit and used to ignite gas burner 144 during power disruption event, including during a loss of external electrical power such as a power outage, blackout, or brownout, or during a user selected religious mode, where external electrical power or independent ignition of a flame is unwanted.

Additionally or alternatively, pilot light 206 may be doused by controller 127 or controller 230. For example, controller 127 or auxiliary controller 230 may be configured to close auxiliary gas valve 218 to douse pilot light 206. Auxiliary gas valve 218 may be used to extinguish or douse pilot light 206 upon detection of the end of the power disruption event.

Pilot light 206 may be configured to receive an auxiliary gas line 212. Auxiliary gas line 212 may provide gas to pilot light 206, which, when ignited, may produce pilot flame 208. The amount of gas that flows from auxiliary gas line 212 to pilot light 206 may be controlled by use of auxiliary gas valve 218. Controller 127 or auxiliary controller 230 may control auxiliary gas valve 218 to provide gas to pilot light 206 upon detection of a power disruption event, which will be discussed in more detail below. Gas may flow in auxiliary gas flow direction 219 toward pilot light 206.

Additionally or alternatively, pilot light 206 may be ignited using electric igniter assembly 201. For example, electric igniter assembly 201 may ignite auxiliary gas line 212 when auxiliary gas line 212 flows from pilot light 206. Controller 127 or auxiliary controller 230 may be in operable communication with electric igniter assembly 201.

In some embodiments, ignition system 200 may include an internal power source 220. Internal power source 220 may be connected to the electric igniter assembly 201. Internal power source 220 may be configured to provide power to electric igniter assembly 201 to ignite pilot light 206 when a power disruption event is detected. The internal power source 220 may be a battery, a capacitor, or other device capable of storing electricity. The electrical energy stored in the internal power source 220 may then be used in the event of a power disruption event such as a loss of external power. Optionally, ignition system 200 may function without an internal power source 220.

In some embodiments, internal power source 220 (e.g., a battery) could smooth out intermittent power supply or store power from pilot light 206 or gas burner 144 to be used when a user interacts with appliance 100. In some embodiments, internal power source 220 could store power between intermittent power availability. For example, if internal power source 220 is charged using an oven gas burner and thermopile 222 connected to the oven gas burner, internal power source 220 may store power in between times the oven gas burner is in use.

In some embodiments, the internal power source 220 is further connected to a thermopile 222, the thermopile 222 configured to recharge the internal power source 220. Thermopile 222 may be operably coupled to pilot light 206. Thermopile 222 may convert heat into electrical energy for use by ignition system 200 or appliance 100. For example, thermopile 222 may generate electricity from pilot light 206 to power an auxiliary controller 230 during the power disruption event. In some embodiments, the internal power source 220 is further connected to thermopile 222, thermopile 222 configured to recharge the internal power source 220 when thermopile 222 is powered by pilot light 206.

In some examples, thermopile 222 may further be installed on gas burner 144 of appliance 100. In some embodiments, thermopile 222 may be installed on pilot light 206. Thermopile 222 may be used to provide additional power during cook cycles or during use of gas burner 144 during the power disruption event.

Additionally or alternatively, a thermopile 222 may be installed on one or more gas burners 144 of appliance 100, including gas oven burners (e.g., as would be in oven cooking chambers 120, 122) to provide additional power while one or more gas burners 144 are in use. In some examples, additional power may only be needed when operating an oven portion of appliance 100, such as a gas powered oven (e.g., oven cooking chambers 120, 122). The additional power may be used to power closed loop control functions, temperature display functions, oven lights, or other auxiliary electrical oven functions. In this manner, thermopile 222 attached to at least one gas oven burner provides additional power when the power is most likely to be needed or desired by the user. Advantageously, power would be available when most desired or needed, and additional gas or energy would not be wasted when power is less desired or not needed.

Internal power source 220 may store energy harnessed by thermopile 222, allowing energy to be available even when gas burner 144 (including an oven gas burner) is not turned on. For example, if internal power source 220 is a battery, thermopile 222 connected to gas burner 144 may recharge the battery. Pilot light 206 may also aid in recharging internal power source 220 using thermopile 222. Pilot light 206 may recharge internal power source 220 at a slower rate than gas burner 144. Advantageously, using thermopile with gas burner 144 to recharge internal power source 220 may provide adequate power to the appliance to offset additional usage when gas burner 144 is in use (including when gas burner 144 is an oven gas burner), allowing the internal power source 220 to recharge fast enough to account for additional power use when the oven, e.g., oven cooking chamber 120 or 122, is in operational use.

Ignition system 200 may include auxiliary controller 230. Auxiliary controller 230 may be a part of controller 127, may be a module on controller 127, may be a separate controller 230 from 127, or may be otherwise operably connected to or separate from controller 127. Auxiliary controller 230 may be powered by thermopile 222. Auxiliary controller 230 may be functional in a manner similar to, and may have similar components to, controller 127, as described above. Auxiliary controller 230 may be configured to maintain operability of appliance 100. For example, auxiliary controller 230 may be configured to allow operation of gas burner 144 during the power disruption event. In some embodiments, auxiliary controller 230 may be configured to maintain a minimum functionality of appliance 100 during power disruption events.

In some examples, auxiliary controller 230 is further configured to provide increased functionality of appliance 100 during the power disruption event. For example, auxiliary controller 230 may be configured to increase gas flow to pilot light 206 to provide additional power to auxiliary controller 230 for increased functionality of appliance 100 during the power disruption event. Gas flow may be increased along auxiliary gas line 212 by auxiliary controller 230. Increased flame of pilot light 206 by increased auxiliary gas line 212 may provide more heat, which is converted to increased electrical output by thermopile 222. Increased electrical output may be used by auxiliary controller 230 to provide increased functionality of appliance 100 during the power disruption event.

Operability of the appliance 100 may be a minimum electrical function of the appliance 100 such as functions that allow the gas burner 144 to be lit from the pilot light 206 and be controlled safely to allow at least one setting of the gas burner 144 during the power disruption event. In some examples, operability may include adjusting the setting of the gas burner 144 during the power disruption event (i.e., adjusting the primary gas line 210 to increase or decrease the size of the gas burner flame 204). Safety measures, e.g., as needed to be in regulatory compliance, which are electrically controlled would be included in operability of the appliance 100 and minimum electrical function of the appliance 100. Increased functionality of the appliance 100 would include more electrical functions than operability of the appliance 100 or minimum electrical function of the appliance 100. For example, timers, temperature controls, or other optional functions of the appliance 100 may be used with increased functionality of the appliance 100.

Auxiliary controller 230 may further have a deep sleep power management mode. Deep sleep power management mode may allow the auxiliary controller 230 to maintain operability of appliance 100 with relatively low electrical power from the thermopile 222.

Figure 4:
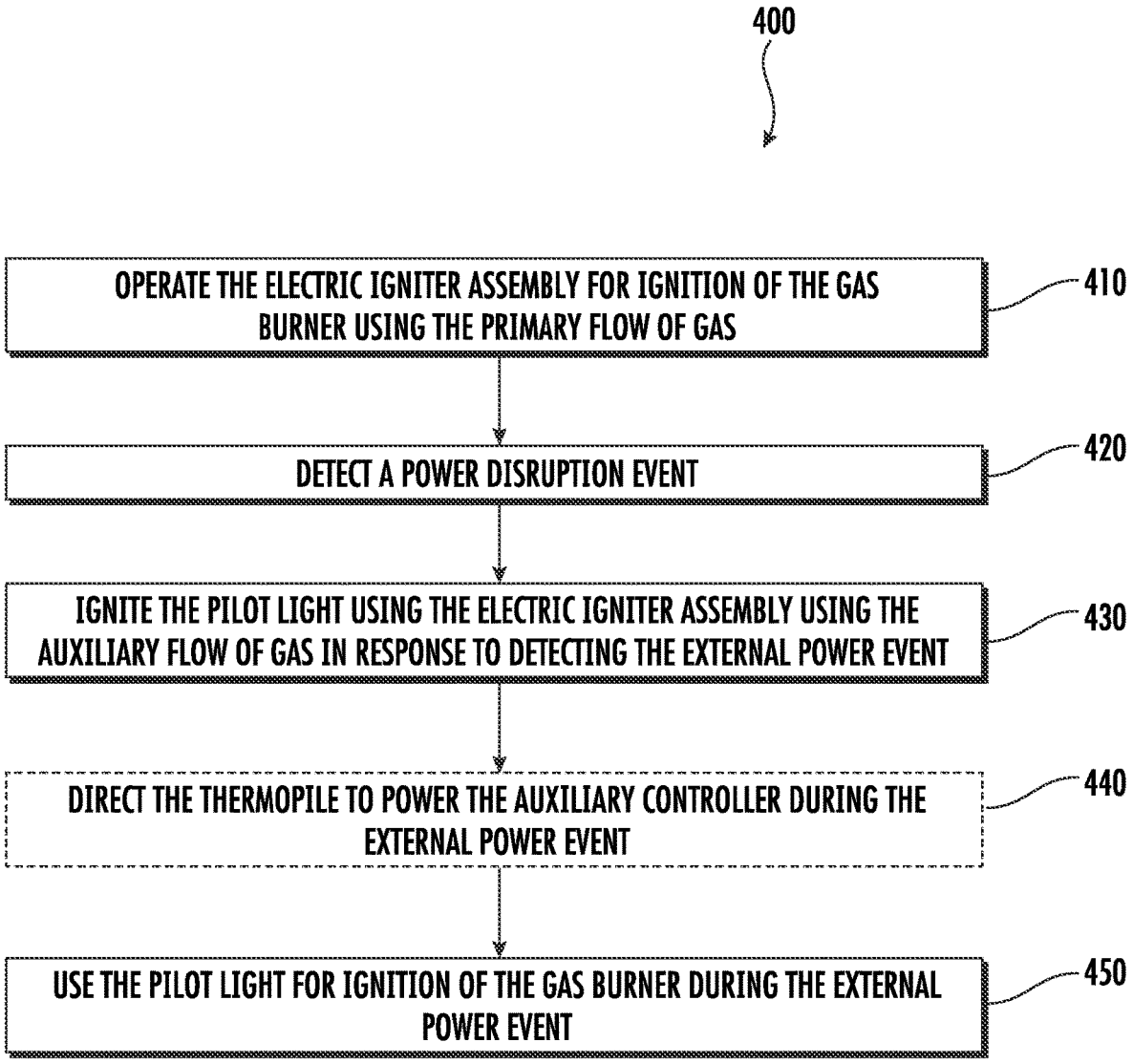
FIG. 4 provides a flow chart illustrating a method of operating a pilot light assembly according to exemplary embodiments of the present disclosure.
Figure 5:
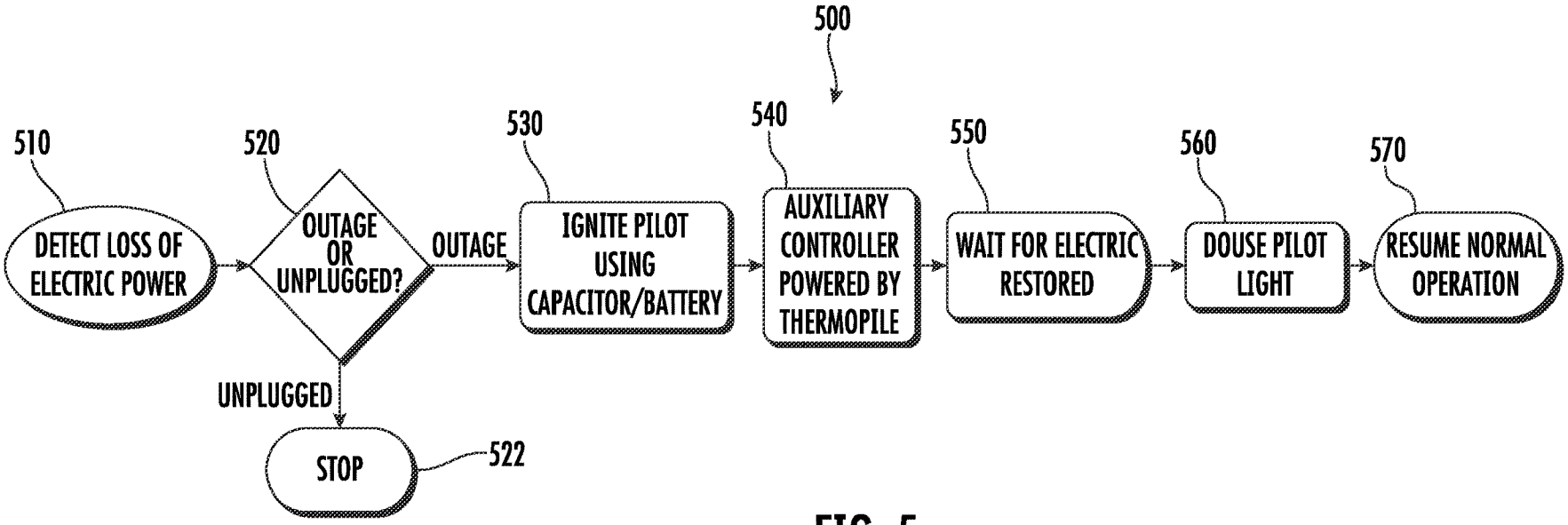
FIG. 5 provides a flow chart illustrating a method of operating a pilot light assembly according to exemplary embodiments of the present disclosure.
Figure 6:
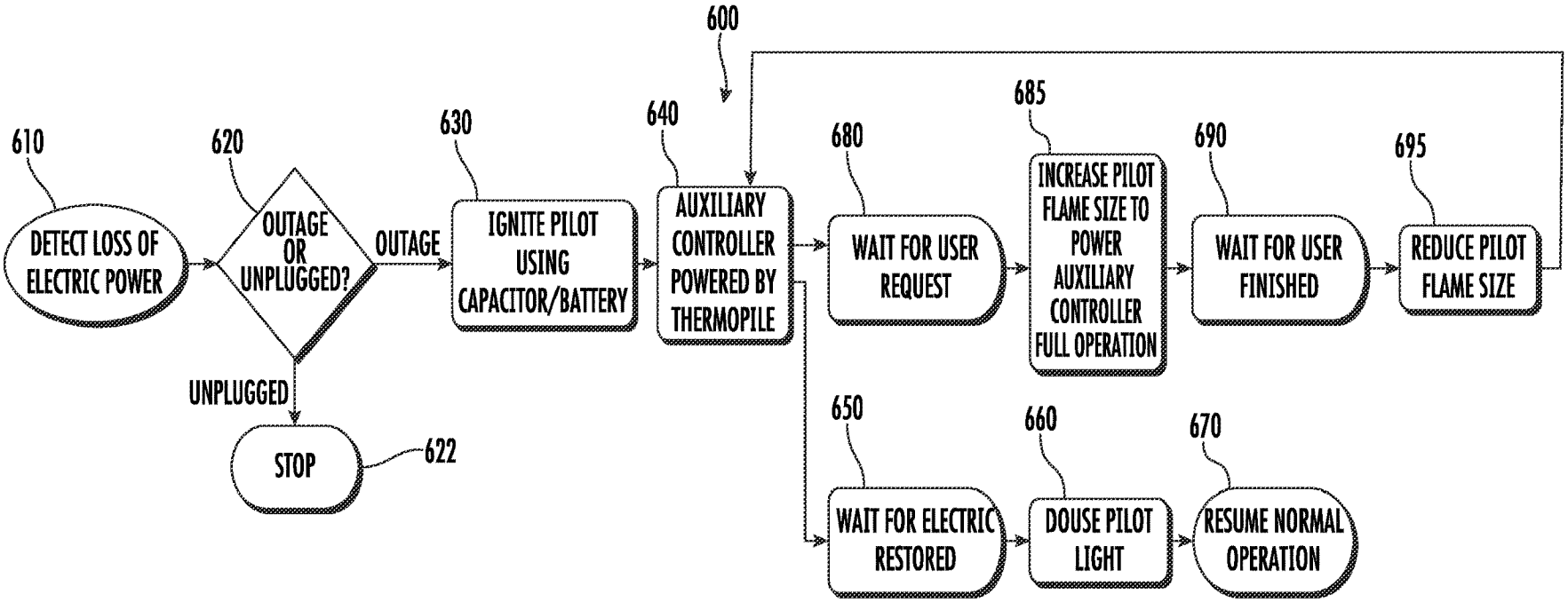
FIG. 6 provides an alternate flow chart illustrating a method of operating a pilot light assembly according to exemplary embodiments of the present disclosure.

Turning to FIGS. 4 through 6, various methods (e.g., method 400) may be provided for use with ignition system 200 in accordance with the present disclosure. FIGS. 5 and 6 depict flow charts for various methods and embodiments of the methods described herein. In some embodiments, all, or some of the various steps of the method(s) may be performed by a suitable controller (e.g., controller 127 or auxiliary controller 230). Thus, controller 127 or auxiliary controller 230 may be configured to direct at least a portion of such a method (e.g., as a part of operating appliance 100). During such methods, controller 127 or auxiliary controller 230 may receive inputs and transmit outputs from various other portions of ignition system 200. For example, controller 127 or auxiliary controller 230 may send signals to and receive signals from pilot light 206, gas burner 144, or other components.

The present methods may advantageously allow for an appliance 100 to have a gas burner 144 that is useable without additional electrical power by igniting a pilot light 206 when external electricity is unavailable and has the benefit of using an electric igniter assembly 201 when external electricity is available, to not waste gas when not in use. Thus methods may provide a more energy efficient operation of gas household appliance 100 while providing usability when external electricity is unavailable.

FIGS. 4 through 6 depict steps performed in a particular order for purpose of illustration and discussion. Those of ordinary skill in the art, using the disclosures provided herein, will understand that (except as otherwise indicated) the steps of any of the methods disclosed herein can be modified, adapted, rearranged, omitted, or expanded in various ways without deviating from the scope of the present disclosure.

At step 410, the method 400 includes operating electric igniter assembly 201 for ignition of the gas burner 144. Step 410 may further include using the primary gas line 210 for ignition of gas burner 144. For example, controller 127 may operate electric igniter assembly 201 to ignite primary gas line 210 to ignite gas burner 144. Such may be used during operation outside of a power disruption event, or when external electrical power is available to appliance 100. Such operation may also herein be termed "normal operation."

At step 420, the method 400 includes detecting a power disruption event. The power disruption event may be a requested event from a user or may be a detection of a loss of an external electrical power source. Controller 127 may detect the power disruption event.

In some examples, detecting the power disruption event includes receiving a request to turn on a religious mode setting. Detecting the power disruption event may further include turning off electric igniter assembly 201 after igniting the pilot light 206 to enter the religious mode setting.

Religious mode setting may be desired for religious observances where external electricity or igniting new flames is not permitted, such as for Shabbos, Shabbat, Sabbath, or other religious observances. Placing the appliance in religious mode setting may include configuring the appliance 100 to turn off electrical adjustment controls and all electric igniter assemblies following electric ignition of the pilot light 206 and to use only pilot light 206 to ignite gas burner 144 of the appliance 100.

In some examples, detecting the power disruption event includes detecting a disruption of electrical power in an external power source. Detecting the power disruption event may include detecting a loss of an external power source. External power source may include electrical outlet power, and loss may include a blackout event, brownout event, or other loss of an external electrical power source. For example, an external power source may be sourced from an outlet plug that appliance 100 plugs into for external electrical power.

Additionally or alternatively, controller 127 may detect the difference between loss of electrical power at the external power source and a disconnection from that external power source. For example, controller 127 may detect a brownout or a blackout event as a power disruption event. Controller 127 may further differentiate that from appliance 100 being unplugged from an electrical outlet, including by checking if a ground connection is active, or as otherwise understood.

For example, method 400 may include detecting the appliance 100 is unplugged, dousing the pilot light 206, and turning off the electric igniter assembly 201. Controller 127 or auxiliary controller 230 may detect the appliance 100 is unplugged. Closing auxiliary gas valve 218 may be used to douse pilot light 206, which may be directed by controller 127 or auxiliary controller 230. Electric igniter assembly 201 may also be turned off by controller 127 or auxiliary controller 230. Advantageously, if a user unplugs the appliance, such as for maintenance or moving appliance 100, appliance 100 may be unpowered to meet a user's expectations and to maintain safety. Generally, a user may believe an unplugged appliance is an unpowered appliance, and dousing pilot light 206 in response to detecting the appliance 100 is unplugged may be used to meet the user's expectations and maintain safe conditions around the appliance 100.

At step 430, the method 400 includes igniting the pilot light 206 using the electric igniter assembly 201. The pilot light 206 may use the auxiliary gas line 212 for a fuel source. Igniting the pilot light 206 may be performed in response to detecting the power disruption event. Controller 127 may ignite the pilot light 206 using the electric igniter assembly 201.

When the power disruption event is a request to begin the religious mode setting, further external electrical power may not be used during the execution of the religious mode setting. A user may request entry into and removal from the religious mode setting. A user may use knobs 156, graphical display 155, or interface panel 154 to request such entry and removal from the religious mode setting.

At step 440, the method 400 may include using the thermopile 222 to power the auxiliary controller 230 during the power disruption event. The auxiliary controller 230 may perform functions to maintain operability of the appliance 100 during the power disruption event. Thermopile 222 may provide power to the auxiliary controller 230 to perform functions needed to operate the appliance 100 during the power disruption event.

In some examples, using the thermopile 222 to power the auxiliary controller 230 during the power disruption event may include increasing gas flow to the pilot light 206 to provide additional power to the auxiliary controller 230. Auxiliary gas line 212 may be increased by auxiliary controller 230 during the power disruption event to increase the flame size or heat output of the pilot light 206. This additional flame size may allow the thermopile 222 to increase power output. In turn, the auxiliary controller 230 may have increased capacity to perform increased functionality of the appliance 100 during the power disruption event. This increased power may be used on demand, such as when requested by a user. The auxiliary gas flow may be decreased when increased functionality is not needed or not requested by the user (e.g., when the gas burner 144 is not being used, increased functionality may also be turned off and the pilot flame 208 may be reduced in size).

At step 450, the method 400 includes using the pilot light 206 for ignition of gas burner 144 during the power disruption event. Once the pilot light 206 is ignited, the pilot light 206 may be used as a flame source to ignite the gas burner 144 of the appliance 100. The auxiliary controller 230 or the controller 127 may use the pilot light 206 for ignition of the gas burner 144 during the power disruption event.

In some embodiments, the method 400 may further include detecting an end of the power disruption event and dousing the pilot light 206 in response to detecting the end of the power disruption event. The controller (e.g., controller 127 or auxiliary controller 230) may receive a user request to end the power disruption event, such as a request to end the religious mode setting. In some examples, the controller 127 (e.g., controller 127 or auxiliary controller 230) may detect a return of external electrical power, which may end the power disruption event. Controller 127 or auxiliary controller 230 may douse the pilot light 206. Controller 127 may then return to using the electric igniter assembly 201 for ignition of the gas burner 144.

FIG. 5 depicts an example flow chart of a method 500 according to embodiments described herein. A controller, such as controller 127, may direct such a method for an appliance 100. At step 510, a loss of external electrical power is detected by the controller 127. At step 520, controller (e.g., either controller 127 or auxiliary controller 230) determines if the loss of external electrical power was from a power outage, or if the appliance 100 was unplugged or removed from an external power source. At step 522, if the power loss is because of removal from the external power source, the controller takes no further action. At step 530, if the loss of power was determined to be a power outage, the pilot light 206 is ignited using power from an internal energy source such as a capacitor or battery. At step 540, an auxiliary controller (e.g., auxiliary controller 230) is powered by a thermopile 222 using the pilot light 206 for an energy source. At step 550, the controller (e.g., either controller 127 or auxiliary controller 230) detects external electricity has been restored. At step 560, the pilot light 206 is doused by a controller (e.g., either controller 127 or auxiliary controller 230). Controller may close auxiliary gas valve 218 to douse pilot light 206. At step 570, the controller (e.g., controller 127) may resume normal operation or, in other words, may resume igniting the gas burner 144 using the electrical igniter assembly.

FIG. 6 depicts another example flow chart of a method 600 according to embodiments described herein. A controller 127, such as controller 127, may direct such a method for an appliance 100. At step 610, a loss of external electrical power is detected by the controller 127. At step 620, a controller (e.g., either controller 127 or auxiliary controller 230) determines if the loss of external electrical power was from a power outage, or if appliance 100 was unplugged or removed from an external power source. At step 622, if the power loss is because of removal from the external power source, the controller takes no further action. At step 630, if the loss of power was determined to be a power outage, the pilot light 206 is ignited using power from an internal energy source such as a capacitor or battery. At step 640, an auxiliary controller (e.g., auxiliary controller 230) is powered by a thermopile 222 using the pilot light 206 for an energy source. At step 650, the controller (e.g., either controller 127 or auxiliary controller 230) detects external electricity has been restored. At step 660, the pilot light 206 is doused by a controller (e.g., either controller 127 or auxiliary controller 230). Controller may close auxiliary gas valve 218 to douse pilot light 206. At step 570, the controller (e.g., controller 127) may resume normal operation or, in other words, may resume igniting the gas burner 144 using the electrical igniter assembly.

Additionally or alternatively, at step 680, controller (e.g., auxiliary controller 230) may receive a request from a user to increase operations beyond minimal operations necessary to have operability of appliance 100. At step 685, controller (e.g., auxiliary controller 230) responds to request to increase operations by increasing pilot light 206 flame by increasing auxiliary gas line 212 (e.g., by increasing an opening of auxiliary gas valve 218) to pilot light 206 to provide additional power to the auxiliary controller (e.g., auxiliary controller 230) to provide full or increased operability of appliance 100. At step 690, the controller receives input that user is finished using full operability of the appliance 100. For example, the user may turn off the gas burner 144 or use interface panel to indicate a request to reduce operability to minimum functions or lesser functions. At step 695, the controller (e.g., either controller 127 or auxiliary controller 230) reduces the pilot flame 208 size and returns to operating at a minimum functionality of the appliance 100. The auxiliary gas line 212 may be reduced (e.g., by decreasing the opening of auxiliary gas valve 218) to decrease the pilot flame 208. Operating at minimum functionality may include operating auxiliary controller 230 in a deep sleep mode, wherein control functions are activated by a user action such as turning a knob or interacting with interface panel or graphical display of appliance 100. Auxiliary controller 230 in deep sleep mode may reduce operations to monitoring pilot light 206 or safety operations, as would be required by regulation, or otherwise understood.

In additional or alternative embodiments, controller (e.g., either controller 127 or auxiliary controller 230) may be configured to douse pilot light 206 (e.g., by closing auxiliary gas valve 218 to auxiliary gas line 212) when internal power source 220 is fully charged during the power disruption event (e.g., during detection of a loss of an external power source or detection of a disruption of electrical power in an external power source) and may be configured to reignite pilot light 206 when the internal power source 220 is running low on stored electrical power (e.g., when internal power source 220 is has less than half or less than one third or less than one quarter of its power capacity stored). Internal power source 220 may be used by the controller to reignite pilot light 206 during the power disruption event using the electric igniter assembly 201. In some examples, when the internal power source 220 has sufficient power to douse the pilot light 206, controller may ignite gas burner 144 to generate gas burner flame 202 using electric igniter assembly 201. In some embodiments, dousing pilot light 206 and using electrical igniter assembly 201 may be improper during a religious mode, and may be used only for a loss or disruption to an external power source.

Embodiments described herein may include a pilot system in a gas range. The system may include both an electric igniter and a gas pilot light. The system may be able to switch between each ignition method using a controller. Advantageously, embodiments may be able to have electric power which is convenient and efficient but require electricity to function and use the pilot-light ignition systems when electricity is unavailable without burning fuel when the appliance is not in use and electricity is available.

In some embodiments, a smart pilot ignition system for the gas range may be used. The ignition system may utilize both an electric igniter assembly and gas pilot and may switch between each other using the controller with or without user intervention. The gas pilot light may be lit by the electric ignitor using main power or a battery or capacitor. The gas pilot light may be controlled by an electronic controller to increase gas flow. In the event of a power outage, the gas pilot light may be lit automatically using a small battery or capacitor; a thermopile coupled with the pilot light or appliance burner may power the range's electronic control systems to maintain operability during power outages. In some examples, the thermopile may also provide additional power during cook cycles.

The pilot light may also be lit in response to a user request or other programmed conditions. The flame may remain lit continuously during Shabbos but may return to electric operation once electric power is restored. Advantageously, methods described herein may allow the user to have full functionality of the gas appliance during electric blackouts and also have a backup or secondary ignition source in case a component failure occurs in either ignition mode. This system may also allow "off-grid" use of gas appliances with electronic controls where electric supply is intermittent or unavailable.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ignition system for igniting a gas burner of an appliance, the ignition system comprising:
- a gas burner;
- an electric igniter assembly;
- a pilot light ignitable by the electric igniter assembly;
- an internal power source connected to the electric igniter assembly and configured to provide power to the electric igniter assembly to ignite the pilot light when a power disruption event is detected;
- a thermopile operably coupled to the pilot light or to the gas burner to generate electrical energy;
- an auxiliary controller powered by the electrical energy from the thermopile and configured to maintain operability of the appliance during the power disruption event, wherein the auxiliary controller is further configured to increase gas flow to the pilot light to provide additional power to the auxiliary controller for increased functionality of the appliance during the power disruption event; and
- a controller in operable communication with the electric igniter assembly, the controller configured to:
  - operate the electric igniter assembly for ignition of the gas burner;
  - detect the power disruption event;
  - ignite the pilot light using the electric igniter assembly in response to detecting the power disruption event; and
  - use the pilot light for ignition of the gas burner during the power disruption event.

2. The ignition system of claim 1, wherein the thermopile is configured to recharge the internal power source when powered by the pilot light or by the gas burner.

3. The ignition system of claim 1, wherein detecting the power disruption event comprises receiving a request to turn on a religious mode setting and turning off the electric igniter assembly after igniting the pilot light to enter the religious mode setting.

4. The ignition system of claim 1, wherein detecting the power disruption event comprises detecting a loss of an external power source or detecting a disruption of electrical power in an external power source.

5. The ignition system of claim 1, wherein the controller is further configured to detect an end of the power disruption event and douse the pilot light in response to detecting the end of the power disruption event.

6. The ignition system of claim 1, wherein the controller is further configured to:
- detect the appliance is unplugged;
- douse the pilot light; and
- turn off the electric igniter assembly.

7. The ignition system of claim 1, wherein the ignition system is designed to ignite the gas burner of a water heater, a gas range, a gas cooktop appliance, grill appliance, furnace, clothes dryer, or other gas powered household appliance.

8. A method of operating an appliance with a gas burner, an electric igniter assembly, and a pilot light, the method comprising the steps of:
- operating the electric igniter assembly for ignition of the gas burner;
- detecting a power disruption event;
- igniting the pilot light using the electric igniter assembly in response to detecting the power disruption event;
- using the pilot light for ignition of the gas burner during the power disruption event; and
- detecting an end of the power disruption event and dousing the pilot light in response to detecting the end of the power disruption event.

9. The method of claim 8, wherein detecting the power disruption event comprises receiving a request to turn on a religious mode setting and turning off the electric igniter assembly after igniting the pilot light to enter the religious mode setting.

10. The method of claim 8, wherein detecting the power disruption event comprises detecting a loss of an external power source.

11. The method of claim 8, wherein detecting the power disruption event comprises detecting a disruption of electrical power in an external power source.

12. The method of claim 8, further comprising:
- detecting the appliance is unplugged;
- dousing the pilot light; and
- turning off the electric igniter assembly.

13. The method of claim 8, further comprising:
- increasing gas flow to the pilot light to provide additional power to an auxiliary controller.

14. An appliance having an ignition system, the appliance comprising:
- a primary gas line;
- a gas burner for receiving the primary gas line;
- an auxiliary gas line;
- a pilot light for receiving the auxiliary gas line;
- an electric igniter for igniting one of the gas burner or the pilot light;

an internal power source configured to provide electricity to the electric igniter assembly for igniting the pilot light upon detection of a power disruption event;

a thermopile operably coupled to the pilot light;

an auxiliary controller powered by the thermopile and configured to maintain operability of the appliance; and a controller in operable communication with the electric igniter assembly, the controller being configured to:

operate the electric igniter assembly for ignition of the gas burner using the primary gas line;

detect a power disruption event, wherein detecting the power disruption event comprises receiving a request to turn on a religious mode setting or detecting a disruption of electrical power in an external power source;

ignite the pilot light using the electric igniter assembly using the auxiliary gas line in response to detecting the power disruption event;

direct the thermopile to power the auxiliary controller during the power disruption event; and use the pilot light for ignition of the gas burner during the power disruption event.

* * * * *